United States Patent [19]

Pehr

[11] 4,409,271

[45] Oct. 11, 1983

[54] LIGHTWEIGHT CONSTRUCTION ELEMENT

[75] Inventor: Harald Pehr, Gödersdorf, Austria

[73] Assignee: Pehr Holding Gesellschaft, Villach, Austria

[21] Appl. No.: 331,220

[22] Filed: Dec. 16, 1981

[30] Foreign Application Priority Data

Dec. 16, 1980 [AT] Austria ..... 6114/80

[51] Int. Cl.[3] ..... B32B 3/06; B32B 33/00

[52] U.S. Cl. ..... 428/71; 156/79; 428/69; 428/76; 428/86; 428/250; 428/304.4; 428/318.4

[58] Field of Search ..... 428/69, 71, 86, 250, 428/289, 304.4, 318.4, 319.3; 156/79

[56] References Cited

U.S. PATENT DOCUMENTS 3,329,750 7/1967 Growald ..... 156/79

3,705,645 12/1972 Konen ..... 428/69

*Primary Examiner*—Paul J. Thibodeau

*Attorney, Agent, or Firm*—Watson, Cole, Grindle & Watson

[57] ABSTRACT

A lightweight construction element is provided with a fabric backing from untrimmed velvet fabric, coated to render it airtight and pressure resistant, with the internal space thereof allowing pressurization. With the pressurizing medium filled in, the yarn linking the two outer fabric webs will maintain a predetermined distance between the fabric webs and ensure high stability of the element.

8 Claims, 4 Drawing Figures

LIGHTWEIGHT CONSTRUCTION ELEMENT

BACKGROUND OF THE INVENTION

The present invention relates to a lightweight construction element, comprising a fabric backing, coated to render it airtight and pressure resistent.

DESCRIPTION OF THE PRIOR ART

In a known lightweight construction element of this category, the fabric backing is fabricated from a flexible foil of composite material, provided with a textile web produced from synthetic yarn and coated on both sides with plastic. Two sections of plastic foil, cut to size and fixedly joined to each other by sealing or bonding their edges, are filled with a semi-rigid or still elastically deformable plastic foam, which structure is produced by pouring plastic material directly into the cavity.

This lightweight construction element is of the disadvantage that its production requires metallic molds for absorbing the high pressures prevailing when pouring the plastic foam material. The shape of the lightweight construction element, once it has been completed, cannot be altered any more and it is also not possible to fold it into a small volume for purposes of transportation.

Another known lightweight construction element is assembled from two identical sections. Each section has a fabric substrate onto which a number of parallel ribs formed from polyurethane foam with triangular, rectangular or trapezoidal cross-section are fixed by means of a textile web. Between the individual ribs, the fabric web is joined to the fabric substrate by seams. Both sections are laid one upon the other, so that their ribs will mesh like gear teeth. The lightweight construction element is provided with two covering layers of fabric and impregnated with a liquid plastic to which a catalyst for curing of the plastic is added.

But this lightweight construction element can likewise not be folded when not in use.

Furthermore a lightweight construction element is known, which is provided with glass-fiber reinforced polyester panels, wherein the space enclosed by the polyester panels contains a frame structure in the form of coils from metal wire or from glass-fiber reinforced polyester, or in the form of a mesh constructed from such coils. The individual coils are imbedded in a fabric layer impregnated with polyester. Although this construction will increase the load-bearing capacity of the lightweight construction element, it is also not possible therein, to fold the element when not in use or when it is to be transported.

Finally, it has also been proposed to use air-filled cushion-type elements for different technical applications. Such cushion-type elements are fabricated from a foil-type material, with the foil edges joined by sewing, bonding or sealing.

Although such cushion-type elements generally allow folding into a small volume when not in use, their disadvantage is that certain limits are set for their shape, as their shape will depend upon the pressure of the air or other medium used for inflation, and they can therefore not be designed as, respectively, a panel-shaped or casing-shaped lightweight construction element with exactly prescribed dimensions since the pressure of the filled-in pressurizing medium will force areas of larger dimensions to bulge outwards.

SUMMARY OF THE INVENTION

The present invention has as an object to eliminate the aforenamed disadvantages of known designs and to create a lightweight construction element of the initially outlined type, having dimensional stability despite its low weight, also being of simple construction and inexpensive to fabricate, and for which no costly metallic molds should be required. The surfaces of the lightweight construction element should, furthermore, not bulge outward upon pressurization of the internal space thereof.

According to this invention, this is attained by a fabric backing consisting of an untrimmed velvet fabric, with the airtight coating allowing to pressurization of the internal space of the velvet fabric. The vertical pile yarn linking the two velvet fabric webs will hold these two webs at a predetermined distance when the internal space of the velvet fabric is filled with a pressurizing medium. These vertical pile yarns will reliably prevent bulging out of the fabric webs during the filling process and after its conclusion. High stability of the filled lightweight construction element will concomitantly be ensured thereby.

When using a gaseous or liquid medium as a pressurizing agent, it will be practicable to relieve the pressure in the internal space of the lightweight construction element when the element is not to be used any longer, and then to fold up the element. It will thus be possible to save space in storage and transportatation. Installing and removing the element is extremely simple and may be made by unskilled personnel without requiring any special training.

Should it be intended however, to use the lightweight construction element only once, it will be practicable as per a further modification of the invention, to use a hardenable plastic foam as a pressurizing medium. This foam will ensure adequate dimensional stability of the lightweight construction element, and also ensure a relatively low weight.

The invention furthermore provides in another embodiment for a minimum of one feeder pipe to project into the internal space of the lightweight construction element. This will ensure a supply and uniform distribution of any pressurizing medium. It is practicable to use the feeder pipes for arranging a plurality of lightweight construction elements in succession, and to supply these from a single source for the pressurizing medium.

The lightweight construction element as per the present invention may be used with advantage in various fields. It can be utilized in the construction of self-supporting sheds, of tents, movable partition walls of any kind, of casings, jackets for containers, circular silos, formwork elements for the construction industry, etc. Also coming into consideration is use of the element as packing material, particularly since this affords the possibility of saving costs by returning empties in a folded-up state.

DESCRIPTION OF THE DRAWINGS

The present invention is hereinafter more particularly described with reference to various embodiments depicted in schematic manner in the accompanying drawings, wherein.

DESCRIPTION OF THE PREFERRED EMBODIMENTS

Figure 1:
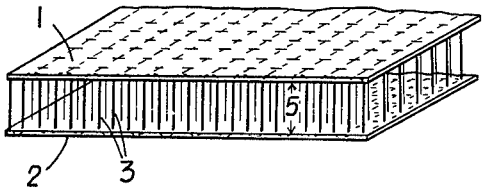
FIG. 1 shows the principle of construction of a lightweight construction element as per the invention.

The lightweight construction element shown in FIG. 1 comprises an a first or upper fabric web 1 and a second or lower fabric web 2, with the fabric webs pressure-resistant coated on their outer sides and linked to each other in the manner of an untrimmed velvet fabric by vertical pile yarns 3. The number of yarns 3 amounts to approximately 30 to 200 per $cm^2$. The distance 5 of upper fabric web 1 from lower fabric web 2 may preferably be between 2 and 20 mm.

Figure 2:
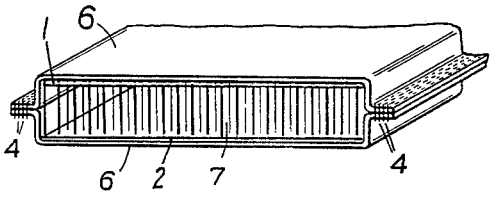
FIG. 2 shows an embodiment of another lightweight construction element in partial section.

In FIG. 2 as well both fabric webs are provided with a coating 6 impermeable to air. Such coating, in general a rubber coating applied by vulcanizing, may be made impact resistant, slip-proof, smooth, rough, resistant to cold or heat, resistant to chemicals, insulting, etc., as may be required. The fabric webs of the lightweight construction element are joined together at both sides by seams 4. Since the coating 6 is impermeable to air, the internal space or chamber 7 of the lightweight construction element may be pressurized and the element thus be made into a stable structure. Suitable as pressurizing media will be primarily gases such as air, helium, etc., or liquids. It is, however, also practicable to fill the internal space 7 with a foamed material, for instance polyurethane foam, which after pouring will harden.

Figure 3:
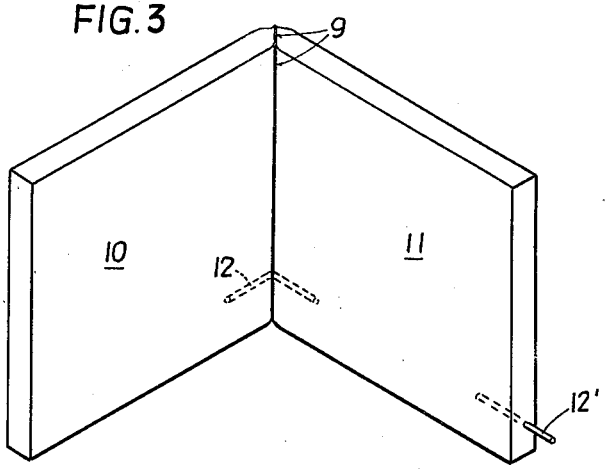
FIG. 3 shows two lightweight construction elements assembled into a unit in axonometric representation.

According to FIG. 3 the two lightweight construction elements 10 and 11 are joined by a layer 9 of a bonding agent. Seams may, however, also be used instead of this bonding layer 9. To allow simultaneous pressurizing of the internal spaces of both elements 10 and 11, their internal spaces are in communication by means of a pipe 12, which is bent to an angle. A straight pipe 12' serves to introduce the pressurizing medium or foam material into the internal space of element 11.

Figure 4:
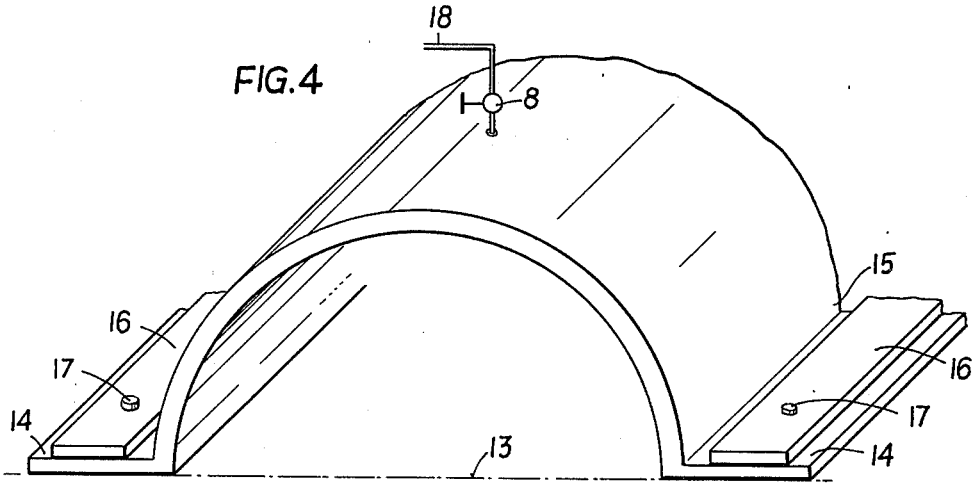
FIG. 4 shows a shed of semicircular cross section, constructed with a lightweight construction element as per invention, in partially oblique view.

The shed shown in FIG. 4, constructed from a construction element as per the invention, is of semicircular cross section with flanges 14 attached to the ends of the arched element and resting upon the base 13. Both flanges 14 are provided at their upper sides with hold-down rails 16 which are fixed to base 13 by means of bolts 17. In this instance, too, a pressurizing medium is supplied to the internal space of the element through piping provided with a manually operable valve 8. This valve 8 is connectable through a supply line 18 to a pressurizing-medium source, for instance a pump or a compressed-air cylinder. Furthermore, the pressurizing medium contained in the lightweight construction element may be vented to the atmosphere by means of valve 8. The shed as shown may be open at its front end since no air lock is required herein as would be the case with air-supported tents.

The present invention is not limited in any way to the embodiments shown in the drawings and described in the aforegoing. It would, for instance, also be practicable to apply to both fabric webs of the lightweight construction element a flexible plastic coating instead of a rubber coating.

I claim:

1. A lightweight construction element comprising:

an untrimmed velvet fabric comprising;

a first fabric web; and a second fabric web separated from said first fabric web and peripherally secured thereto;

a plurality of pile yarns linking said first fabric web to said second fabric web at a predetermined distance; and an airtight pressure resistant coating provided on said first fabric web and on said second fabric web such that an airtight internal chamber is formed having said plurality of pile yarns disposed therein.

2. A lightweight construction element as in claim 1 further comprising a plastic foam disposed in said internal chamber so as to pressurize said internal chamber.

3. A lightweight construction element as in claim 1 further comprising at least one feed pipe passing through said pressure resistant coating and into said internal chamber for pressurizing said internal chamber.

4. A lightweight construction element as in claim 2 further comprising at least one feed pipe passing through said pressure resistant coating and into said internal chamber for pressurizing said internal chamber.

5. A lightweight construction element as in claim 1 wherein said plurality of pile yarns are disposed within a range of 30 to 200 of said pile yarns per $cm^2$.

6. A lightweight construction element as claimed in claim 1 wherein said predetermined distance is maintained within a range of 2 mm to 20 mm.

7. A lightweight construction according to claim 1 wherein said pressure resistant coating comprises a rubber material applied to said first fabric web and said second fabric web by vulcanizing.

8. A lightweight construction element as in claim 1 further comprising a fluid disposed in said internal chamber for pressurizing said internal chamber.

* * * * *